US010004371B2

(12) United States Patent
Hwang et al.

(10) Patent No.: US 10,004,371 B2
(45) Date of Patent: Jun. 26, 2018

(54) CLEANER

(71) Applicant: LG ELECTRONICS INC., Seoul (KR)

(72) Inventors: Philjae Hwang, Seoul (KR); Mantae Hwang, Seoul (KR); Jungbae Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days. days.

(21) Appl. No.: 15/409,859

(22) Filed: Jan. 19, 2017

(65) Prior Publication Data

US 2017/0202416 A1 Jul. 20, 2017

(30) Foreign Application Priority Data

Jan. 19, 2016 (KR) ..... 10-2016-0006346

(51) Int. Cl.

| | |
|---|---|
| ***A47L 9/06*** | (2006.01) |
| ***A47L 5/28*** | (2006.01) |
| ***A47L 13/22*** | (2006.01) |
| ***A47L 13/26*** | (2006.01) |

(52) U.S. Cl.

CPC ..... *A47L 9/0686* (2013.01); *A47L 5/28* (2013.01); *A47L 9/0606* (2013.01); *A47L 13/22* (2013.01); *A47L 13/26* (2013.01)

(58) Field of Classification Search

CPC ..... A47L 9/0686; A47L 9/0606; A47L 5/28; A47L 13/22; A47L 13/26

See application file for complete search history.

(56) References Cited

U.S. PATENT DOCUMENTS

| | | | | |
|---|---|---|---|---|
| 2007/0079470 | A1* | 4/2007 | Rippl | A47L 11/34 15/320 |
| 2009/0252546 | A1 | 10/2009 | Kaleta et al. | |
| 2012/0145191 | A1* | 6/2012 | Williams | A47L 13/17 134/6 |
| 2013/0318725 | A1* | 12/2013 | Kellis | A47L 13/225 8/137 |
| 2014/0075710 | A1* | 3/2014 | Hansen | A47L 13/225 15/320 |
| 2014/0259510 | A1* | 9/2014 | Conrad | A47L 13/225 15/319 |
| 2015/0305588 | A1* | 10/2015 | Dingert | A47L 13/22 15/320 |

FOREIGN PATENT DOCUMENTS

| | | |
|---|---|---|
| KR | 10-2001-0028651 | 4/2001 |
| WO | 2003055372 | 7/2003 |
| WO | 2004062457 | 7/2004 |

OTHER PUBLICATIONS

Extended European Search Report in European Application No. 17151377.3, dated Jun. 29, 2017, 3 pages (with English translation).

* cited by examiner

*Primary Examiner* — Dung Van Nguyen
(74) *Attorney, Agent, or Firm* — Fish & Richardson P.C.

(57) ABSTRACT

A cleaner that includes a nozzle assembly; a cleaner body that is coupled to the nozzle assembly and that is configured to rotate; and a water cleaning device that is coupled to the nozzle assembly, the water cleaning device including: a water tank that is configured to (i) hold a cloth and (ii) store water to provide to the cloth and that includes an air hole through which air enters the water tank from outside of the water tank, and an adjusting device that is configured to open or close the air hole based on a rotation of the cleaner body is disclosed.

20 Claims, 10 Drawing Sheets

CLEANER

CROSS-REFERENCE TO RELATED APPLICATION

This application claims priority to Korean Patent Application No. 10-2016-0006346 filed on Jan. 19, 2016 in Korea, the entire contents of which is hereby incorporated by reference in its entirety.

TECHNICAL FIELD

The present application generally relates to technologies about a cleaner.

BACKGROUND

The cleaner is used to remove a dust or waste for a clean environment.

The cleaner may be classified into a manual cleaner where the user grips and moves the cleaner, and an automatic cleaner where the cleaner moves on its own.

Further, the manual cleaner may be classified into a canister type cleaner, an upright type cleaner, a handy type cleaner, a stick type cleaner, etc.

As a prior art document, Korean Patent application publication No. 2001-0028651 (Apr. 6, 2001) discloses a wet mop having a water injector.

In this document, the wet mop includes a water tank having a water injecting hole and a water injector; a cylindrical shaft fixed on an upper part of the water case to be rotatable; and an operation knob for actuating the water injector and fixed to an end of the cylindrical shaft.

However, in this document, only when the user operates the knob, the water injector works. Thus, the user should frequently operate the knob during the cleaning process. This may lead to inconvenience for the user.

Further, a single knob operation determines the water injection amount. In order to adjust the water injection amount, multiple knob operations are needed. This may lead to inconvenience for the user.

SUMMARY

The present disclosure provides a cleaner having a water cleaning device that is capable of adjusting the amount of water being discharged.

The present disclosure provides a cleaner where water is prevented from being discharged in a cleaner standby state and the water may be discharged in a cleaning process.

The present disclosure provides a cleaner where water may be discharged continuously from a water tank in a state where the water may be discharged.

In general, one innovative aspect of the subject matter described in this specification can be embodied in a cleaner that includes a nozzle assembly; a cleaner body that is coupled to the nozzle assembly and that is configured to rotate; and a water cleaning device that is coupled to the nozzle assembly, the water cleaning device including: a water tank that is configured to (i) hold a cloth and (ii) store water to provide to the cloth and that includes an air hole through which air enters the water tank from outside of the water tank, and an adjusting device that is configured to open or close the air hole based on a rotation of the cleaner body.

The foregoing and other embodiments can each optionally include one or more of the following features, alone or in combination. In particular, one embodiment includes all the following features in combination. The adjusting device is configured to move, based on the rotation of the cleaner body, between a first position and a second position to open or close the air hole. The adjusting device is configured to (i) move to the first position based on the cleaner body being oriented in an upright orientation and (ii) move to the second position based on rotation of the cleaner body. The adjusting device is configured to (i) close the air hole based on the adjusting device being located in the first position and (ii) open the air hole based on the adjusting device being located in the second position. The cleaner of claim 2, further includes an elastic member that is configured to maintain the adjusting device in the first position to close the air hole. The adjusting device includes: a transmitting part that is configured to move based on rotation of the cleaner body, a connecting part that couples the transmitting part to the water tank and that is configured to rotate about a first axis based on movement of the transmitting part, and a cover part that is coupled to the connecting part and that is configured to move, based on the rotation of the connecting part, to open or close the air hole. The transmitting part is configured to move without contacting the nozzle assembly. The transmitting part is configured to move between a first transmitting position and a second transmitting position, and wherein, in the first transmitting position, at least a portion of the transmitting part is located at a first side of the cleaner body and is spaced apart from the cleaner body. The water tank includes: an accommodating groove that is configured to accommodate a portion of the cover part and that is located on a first surface of the water tank, and wherein the air hole is located on a first surface of the accommodating groove. The adjusting device includes: a transmitting part including: a first transmitting part that is configured to move based on rotation of the cleaner body, and a plurality of second transmitting parts that are coupled to the first transmitting part and that are configured to move based on movement of the first transmitting part, and a first connecting part and a second connecting part, wherein each of the first connecting part and the second connecting part (i) respectively couples at least one of the plurality of second transmitting parts to the water tank and (ii) is configured to respectively rotate about a first axis based on movement of the at least one of the plurality of second transmitting part. The first connecting part and the second connecting part extend in a first direction, and the plurality of second transmitting parts extend in a second direction that is different from the first direction. The water tank includes: a first water storage part that is configured to store water to provide to the cloth and that is rotatably coupled to the first connecting part, and a second water storage part that is configured to store water to provide to the cloth and that is rotatably coupled to the second connecting part. The nozzle assembly includes: a connecting part that is coupled to the cleaner body, and wherein the connecting part is located between the first water storage part and the second water storage part. The first water storage part includes the air hole, and wherein the first connecting part that is coupled to the first water storage part includes a cover part that is configured to open or close the air hole. The second water storage part includes a second air hole through which air enters the second water storage part from outside of the water tank, and wherein the second connecting part that is coupled to the second water storage part includes a second cover part that is configured to open or close the second air hole. At least one of the first water storage part or the second water storage part includes the air hole, and wherein at least one of the first water storage part or the second water storage part includes a water inlet through which water enters the water tank.

In general, another innovative aspect of the subject matter described in this specification can be embodied in A cleaner comprising: a nozzle assembly; a water cleaning device that is coupled to the nozzle assembly and that includes: a water tank that is configured to (i) hold a cloth and (ii) store water to provide to the cloth and that includes an air hole through which air enters the water tank from outside of the water tank; and a cleaner body that is coupled to the nozzle assembly, that is configured to rotate, and that includes: an adjusting device that is configured to open or close the air hole based on rotation the cleaner body.

The foregoing and other embodiments can each optionally include one or more of the following features, alone or in combination. In particular, one embodiment includes all the following features in combination. The adjusting device is configured to move, based on rotation of the cleaner body, between a first position and a second position to open or close the air hole. The adjusting device is configured to (i) move to the first position based on the cleaner body being oriented in an upright orientations and (ii) move to the second position based on rotation of the cleaner body. The cleaner further includes: an elastic member that is configured to maintain the adjusting device in the first position to close the air hole.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

The present disclosure will become more fully understood from the detailed description given herein below and the accompanying drawings, which are given by illustration only, and thus are not limitative of the present disclosure, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
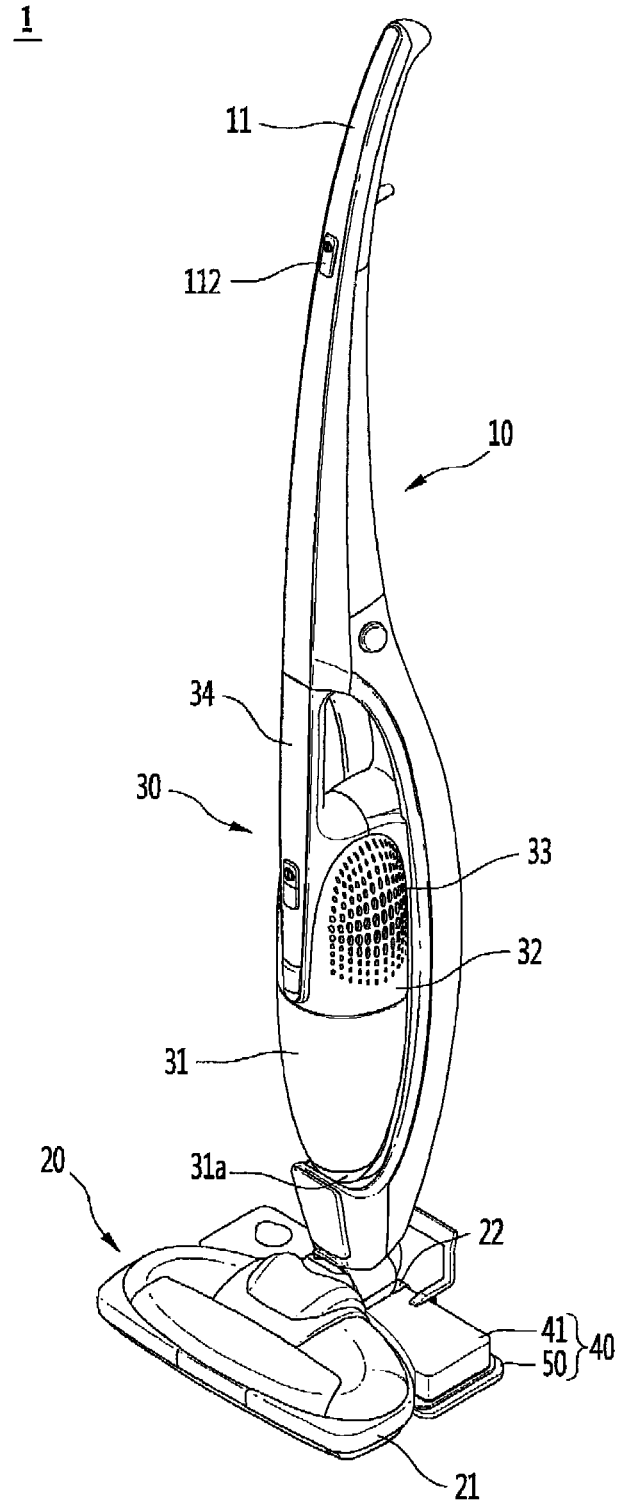
FIG. 1 is a perspective view of a cleaner according to an embodiment of the present disclosure.
Figure 2:
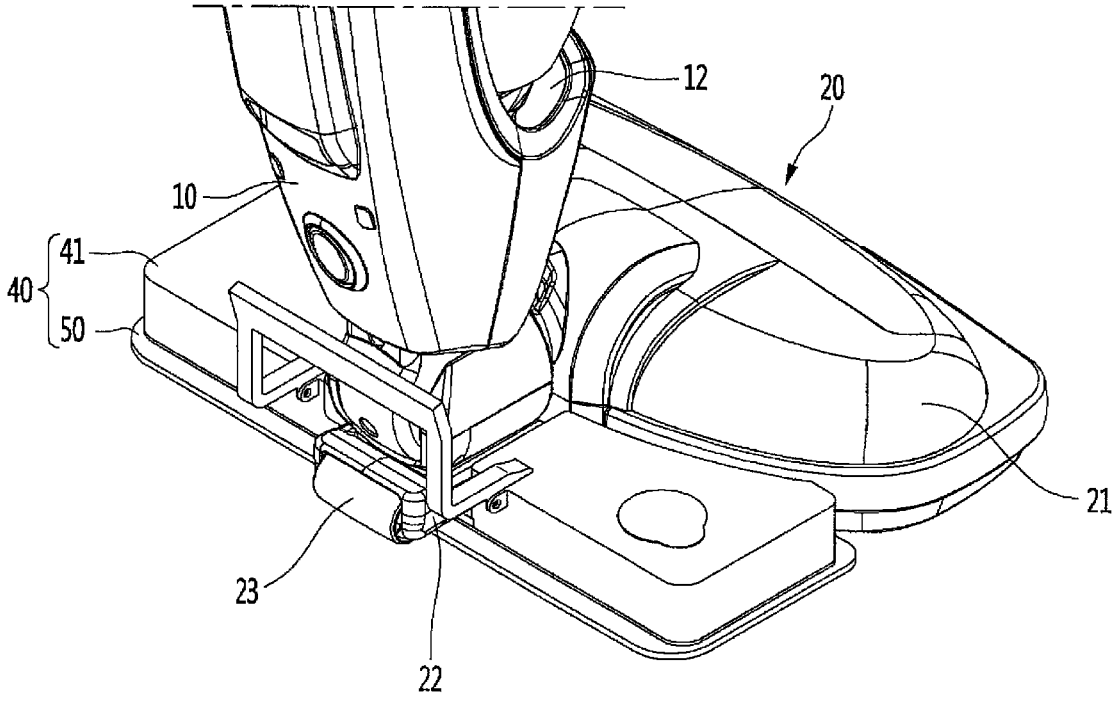
FIG. 2 is a view illustrating a water cleaning device coupled to a nozzle assembly according to an embodiment of the present disclosure.

FIG. 1 is a perspective view of a cleaner according to an embodiment. FIG. 2 shows an enlarged partial view of a combination between a water cleaning device and a nozzle assembly of the cleaner according to the embodiment.

Referring to FIG. 1 and FIG. 2, the cleaner 1 according to the embodiment may include a nozzle assembly 20 to suction a dust from a floor, and a cleaner body 10 rotatably coupled to the nozzle assembly 20.

The cleaner body 10 may exist in a stand up state (the cleaner body disposed at a first position) in a storage state or in a cleaner standby state, and when cleaning, the cleaner body 10 may be rotated about the nozzle assembly 20 by the user to be disposed at a second position. In this document, the second position is not a certain point but a position within a range where the cleaner body may be rotated by the user.

The nozzle assembly 20 may allow the dust suctioned therein to flow into the cleaner body 10.

The cleaner 1 may further include a cleaning unit 30 removably coupled to the cleaner body 10.

The cleaning unit 30 may include a body 32 having a suction motor, and a dust collection unit 31 removably coupled to the body 32 to collect the dust separated from the air.

The dust collection unit 31 may include an air inlet 31*a* to receive an air from the cleaner body 10. The cleaner body 10 may have an air-communication unit 12 communicating with the air inlet 31*a*. The air-communication unit 12 may be disposed at a portion on which the air inlet 31*a* is mounted.

The dust collection unit 31 may include a cover to open or close the air inlet 31*a*. The cover may open the air inlet 31*a* under a suction force of the suction motor. To the contrary, when the suction motor is not activated, the cover may close the air inlet 31*a*.

Thus, when the suction motor is not activated, the cover closes the air inlet 31*a*, to prevent the dust in the dust collection unit 31 from being discharged out of the air inlet 31*a*.

The body 32 may have an air outlet 33 to allow the air passing through the suction motor to be discharged out of the body 32. Further, the body 32 may have a handle 34 at an upper position thereof.

The cleaning unit 30 may further include a battery to supply a power to the suction motor.

Thus, when the cleaning unit 30 is removed from the cleaner body 10, the user may perform cleaning using the cleaning unit 30.

Further, when the cleaning unit 30 is mounted on the cleaner body 10, the suction motor may be activated.

The cleaner body 10 may have a body handle 11. Around the body handle 11, a control unit 112 may be disposed. The user may control the suction motor in the cleaning unit 30 using the control unit 112.

The nozzle assembly 20 may include a nozzle body 21, and a connection 22 extending from the nozzle body 21 and rotatably coupled to the cleaner body 10.

The connection 22 may, for example, extend rearwards in a rear of the nozzle body 21.

A water cleaning device 40 may be coupled to the nozzle assembly 20.

The water cleaning device 40 may include a water tank 41, and a cloth 50 attached to the water tank 41. The water tank 41 may supply water to the cloth 50 to allow the cloth 50 to be wet with water to remove the floor dust.

The cloth 50 may be attached to the water tank 41 at a bottom thereof via adhering means (490 in FIG. 5) such as Velcro. The adhering means to attach the cloth 50 to the water tank 41 may not be limited thereto.

In this embodiment, as long as the water tank 41 is attached to the nozzle assembly 20, a structure of the nozzle assembly 20 and/or a presence/absence the cleaning unit 30 are not limited specifically.

Alternatively, the water tank 41 is not coupled to the cleaner but has a stick coupled to the water cleaning device 40 to clean the floor using the cloth of the water cleaning device 40.

The water cleaning device 40 may be disposed under the nozzle assembly 20. The water cleaning device 40 may be at least partially disposed outside the nozzle assembly 20 when coupled to the nozzle assembly 20.

That is, as shown in FIG. 2, the water cleaning device may be partially disposed under the nozzle body 21 to be overlapped with the nozzle body 21. The water cleaning device 40 may be partially disposed under the connection 22 to be overlapped with the connection 22. Further, the water tank 41 may be partially disposed not to be overlapped with both the nozzle body 21 and the connection 22.

Thus, using this embodiment, when the water cleaning device 40 is coupled to the nozzle assembly 20, the water cleaning device 40 is partially disposed outside the nozzle assembly 20 to allow a contact area between the cloth 50 and water tank 41 to increase. This may lead to an increase in the contact area between the cloth 50 and floor.

Using this embodiment, at a single time cleaning operation, the cloth 50 may remove the dust from a larger area on the floor.

Further, when the user puts one foot on a portion of the water cleaning device 40 outside the nozzle assembly 20, the user may lift up the cleaner 1 to allow the water cleaning device 40 to be removed from the nozzle assembly 20. Thus, the user may remove the water cleaning device 40 from the cleaner 1 easily. The water cleaning device 40 need not have a separate structure in order to be removed.

Further, when the water cleaning device 40 contacts with the nozzle assembly 20, the contact area between the cleaner and floor area increases, to allow the cleaner to stand up on the floor area more stably in the cleaner standby mode.

The water cleaning device 40 may be coupled to the nozzle body 21 and/or the connection 22.

The connection 22 may have one or more rear wheels 23 to allow the nozzle assembly 20 to move easily.

Figure 3:
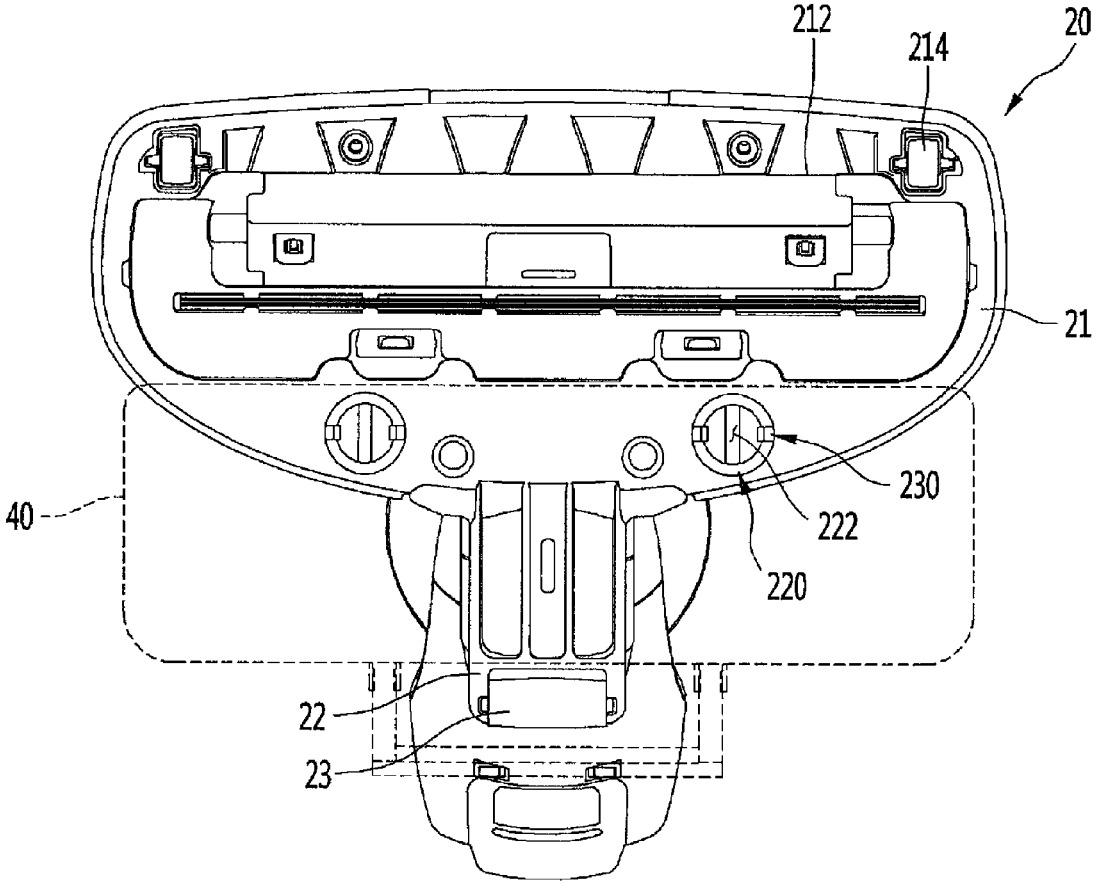
FIG. 3 is a bottom view of the nozzle assembly according to an embodiment of the present disclosure.
Figure 4:
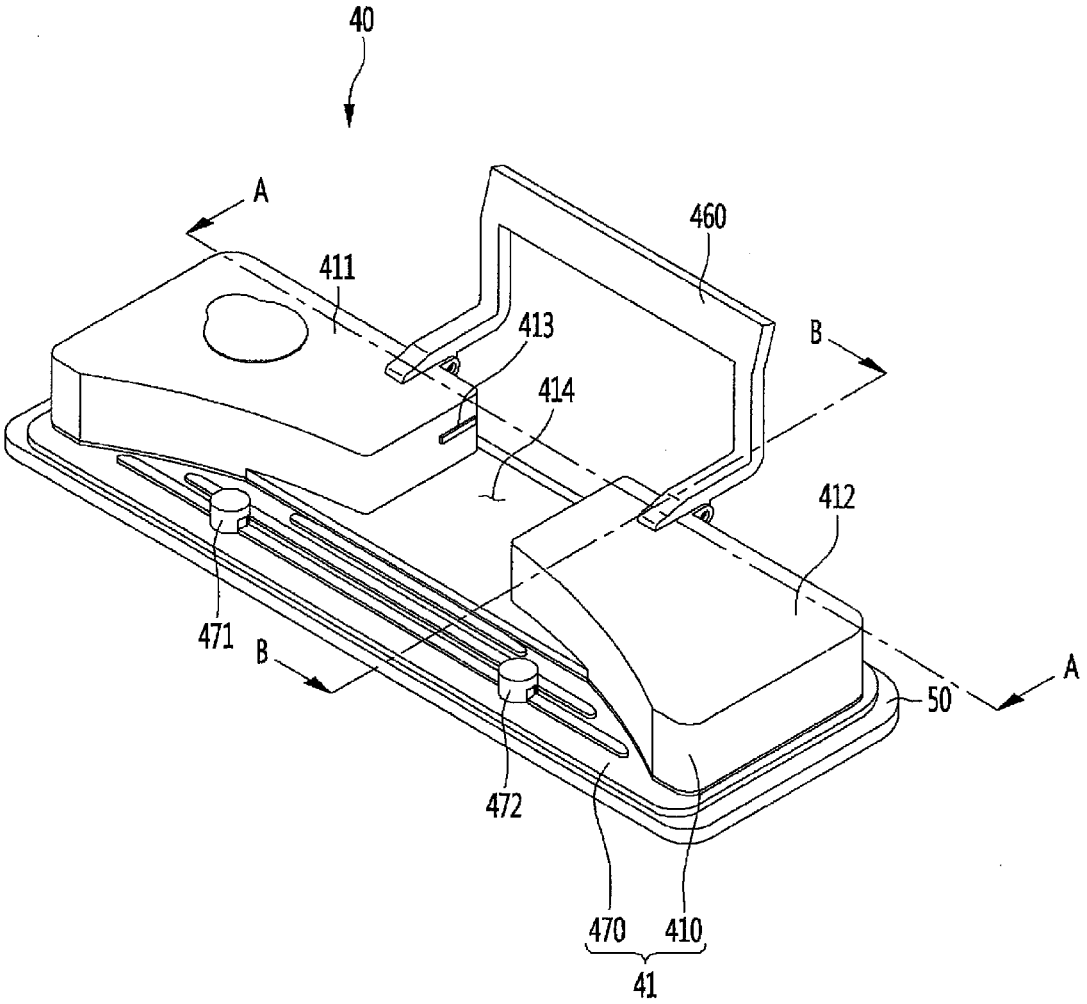
FIG. 4 is a perspective view of the water cleaning device according to an embodiment of the present disclosure.

FIG. 3 is a bottom view of the nozzle assembly according to the embodiment and FIG. 4 is a perspective view of the water cleaning device according to the embodiment.

Referring to FIG. 3 and FIG. 4, the nozzle body 21 may have an air inlet 212.

Further, the nozzle body 21 may have one or more front wheels 214 to move the nozzle assembly 20.

That is, the nozzle assembly 20 may have a plurality of wheels 23 and 214. The plurality of wheels 23 and 214 may include one or more front wheels 214 disposed at the nozzle body 21, and one or more rear wheels 23 disposed at the connection 22.

In order for the nozzle assembly 20 to move stably, a plurality of front wheels 214 may be disposed at the nozzle body 21. The plurality of front wheels 214 may be spaced from each other in a left and right direction.

In order to prevent the water cleaning device 40 from blocking the air inlet 212, the water cleaning device 40 may be disposed in a rear of the air inlet 212. Further, in order to prevent interference between the water cleaning device 40 and the plurality of wheels 23 and 214, the water cleaning device 40 may be disposed in a rear of the front wheel 214 and in a front of the rear wheel 23.

That is, when the water cleaning device 40 is coupled to the nozzle assembly 20, the water cleaning device 40 may be disposed between the front wheel 214 and the rear wheel 23. Further, the water cleaning device 40 may be disposed between the air inlet 212 and the rear wheel 23.

The water tank 41 may include a tank body 410 and a base 470 coupled to a lower side of the tank body 410.

The water tank 41 forms one or more water storage parts 411 and 412. In FIG. 4, a case where the water tank 41 includes a first water storage part 411 and a second water storage part 412 is disclosed as an example, but the number of water storage parts 411 and 412 is not limited in the present disclosure. The one or more water storage parts 411 and 412 form a water storage space.

A space 414 in which the connection 22 of the nozzle assembly 20 is located is formed in the tank body 410. Although not limited, the space 414 may be located between the water storage parts 411 and 412.

Thus, if the water cleaning device 40 is coupled to the nozzle assembly 20, the tank body 410 can support the connection 22.

The water tank 41 may further include a coupling device for allowing the water tank 41 to be coupled to the nozzle assembly 20.

The coupling device may include a first coupling part 471 or 472 for allowing the coupling device to be coupled to the nozzle body 21.

The first coupling part 471 or 472, although not limited, may protrude upward from the base 470. In order for the water tank 41 to be firmly coupled to the nozzle body 21, a plurality of first coupling parts 471 and 472 may be provided at the base 470. The plurality of first coupling parts 471 and 472 may be disposed to be spaced apart from each other in the left-right direction.

The nozzle body 21 may include an accommodating part 220 in which the first coupling part 471 or 472 is accommodated. The accommodating part 220 may be formed as the bottom of the nozzle body 21 is recessed upward.

When the plurality of first coupling part 471 or 472 are provided in the water tank 41, a plurality of accommodating parts 220 may be provided in the nozzle body 21. In this case, the plurality of accommodating parts 220 may also be spaced apart from each other in the left-right direction.

The nozzle body 21 may include a hook member 230 coupled to the first coupling part 471 or 472 in a state in which the first coupling part 471 or 472 is accommodated in the accommodating part 220.

The hook member 230 may be fixed to the nozzle body 21, and at least a portion of the hook member 230 may protrude to the accommodating part 220.

In the process in which the first coupling part 471 or 472 is accommodated in the accommodating part 220, if the hook member 230 is elastically deformed by the first coupling part 471 or 472 and then aligned with a hook accommodating part of the first coupling part 471 or 472, the hook member 230 may be accommodated in the hook accommodating part of the first coupling part 471 or 472.

The coupling device may further include a second coupling part 413 for allowing the coupling device to be coupled to the connection 22.

The second coupling part 413 may be formed at the tank body 410. At this time, since the connection 22 is located between the two water storage parts 411 and 412, the second coupling part 413 may be formed at each of the water storage parts 411 and 412. As an example, the second coupling part 413 may be formed at surfaces of the water storage parts 411 and 412, which are opposite to each other.

If the connection 22 is located between the two water storage parts 411 and 412, the second coupling part 413 may be held to a top surface of the connection 22.

In this embodiment, as the water storage parts 411 and 412 are located at both sides of the connection 22, respectively, the nozzle assembly 20 can be prevented from being separated from the water tank 41 in a process of moving the nozzle assembly 20 to the left or right.

Figure 5:
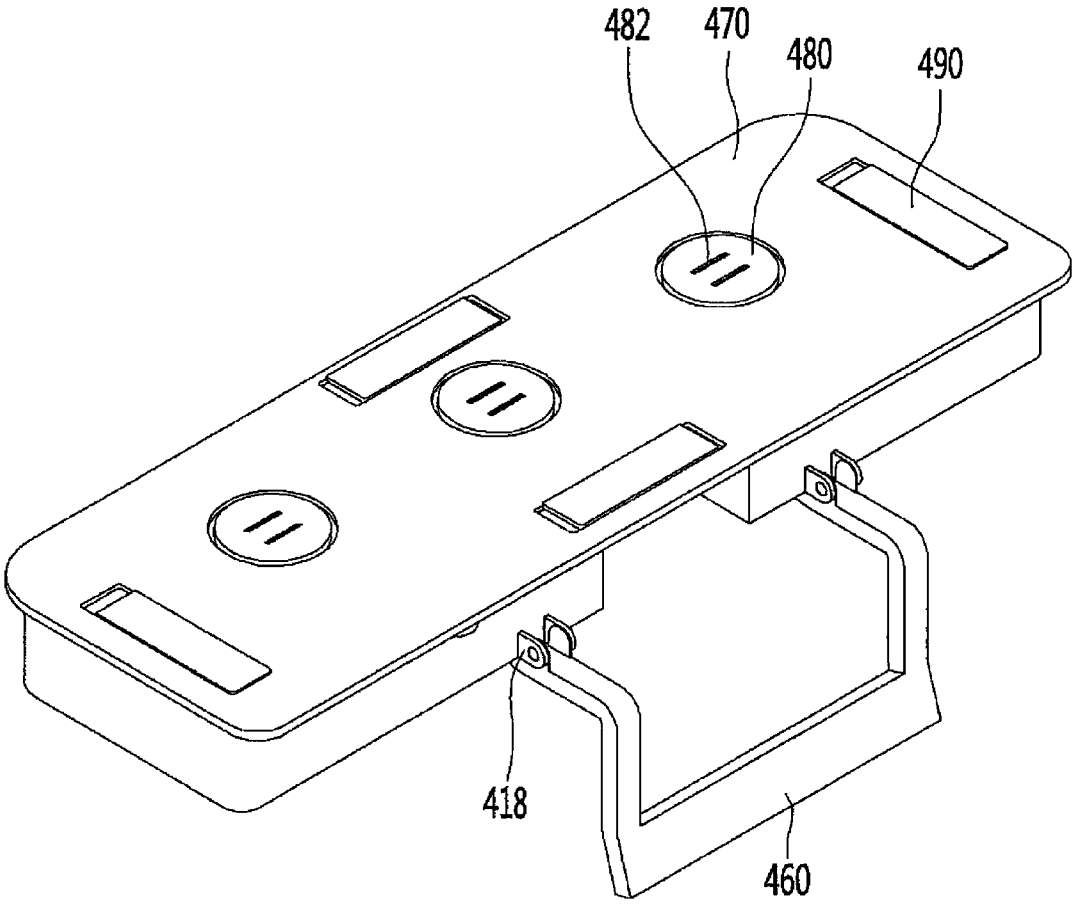
FIG. 5 is a view illustrating a lower side structure of a water tank according to an embodiment of the present disclosure.
Figure 6:
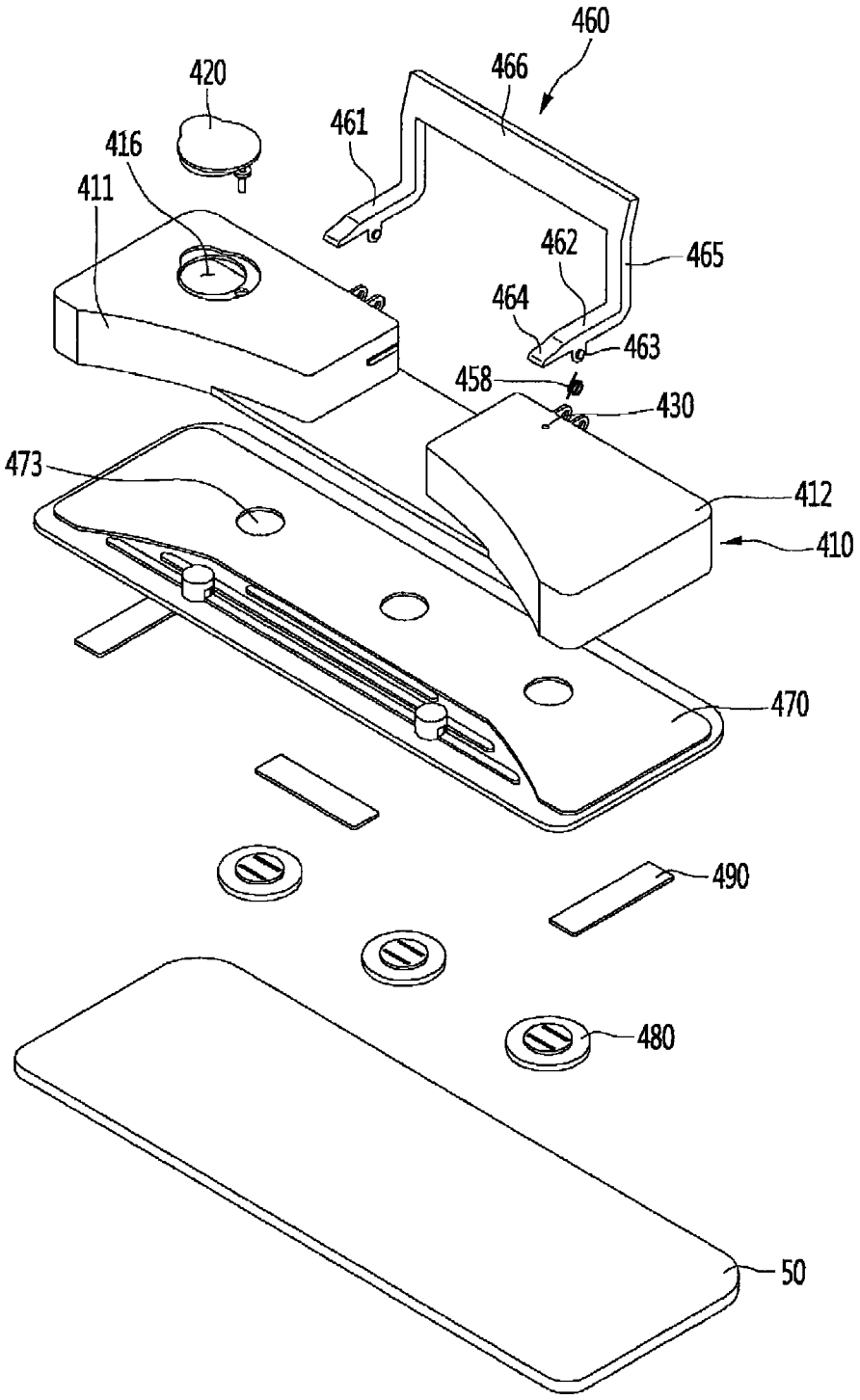
FIG. 6 is an exploded perspective view of the water cleaning device according to an embodiment of the present disclosure.

FIG. 5 is a view illustrating a lower side structure of the water tank according to an embodiment of the present disclosure, and FIG. 6 is an exploded perspective view of the water cleaning device according to an embodiment of the present disclosure.

Figure 7:
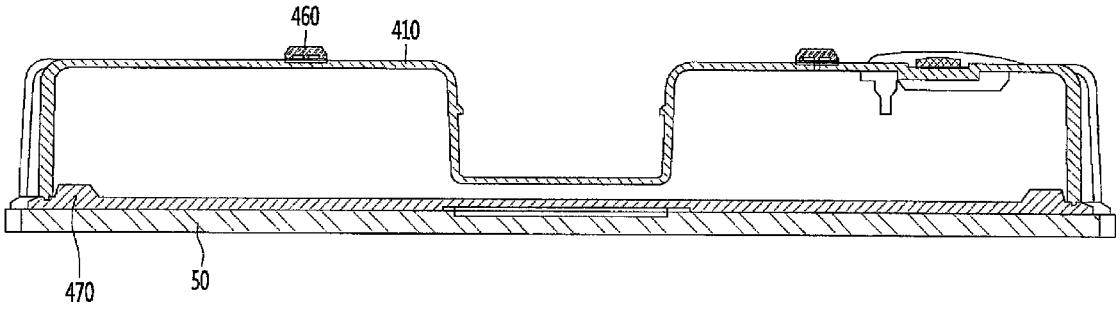
FIG. 7 is a cross-sectional view of FIG. 4, taken along line A-A.
Figure 8:
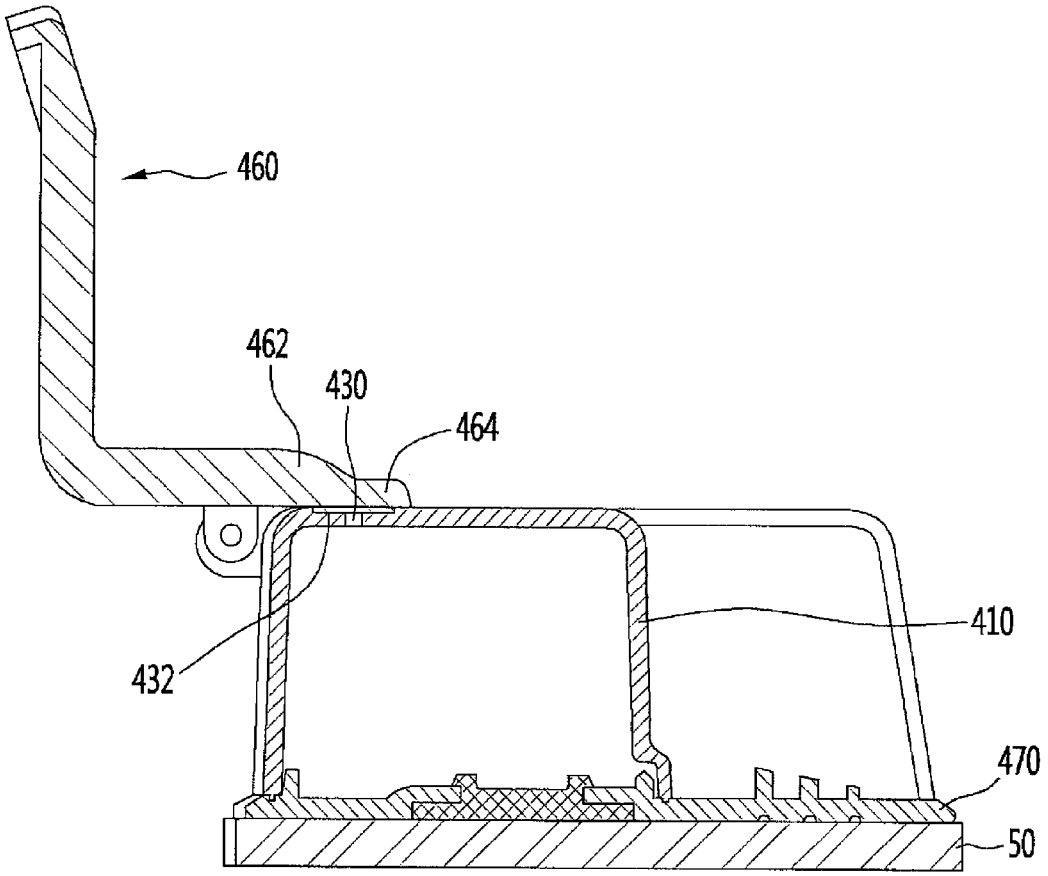
FIG. 8 is a cross-sectional view of FIG. 4, taken along line B-B.

FIG. 7 is a cross-sectional view of FIG. 4, taken along line A-A, and FIG. 8 is a cross-sectional view of FIG. 4, taken along line B-B.

Referring to FIGS. 4 to 8, the tank body 410 may further include a water inlet 416 through which water may be introduced.

The water inlet 416 may be opened and closed by a water inlet cover 420. The water inlet 416 may be provided in the first water storage part 411, but there is no limitation thereto.

The base 470 may have an opening 473. A discharging part 480 for discharging water may be coupled to the opening 473. The discharging part 480 may include one or more discharging holes 482. In another example, the discharging part 480 may be removed, and the opening 473 may serve as the discharging part.

Water stored in the water tank 41 may be supplied to the cloth 50 through the discharging hole 482.

On a lower surface of the base 470, one or more attachment means 490 may be coupled to allow the cloth 50 to be attached.

Meanwhile, the water tank 41 may further include an adjusting device 460 for adjusting introduction of air into the water tank 41.

The adjusting device 460 may allow or block communication between the inner space and the outer space of the water tank 41.

Here, when the communication between the inner space and the outer space of the water tank 41 is blocked by the adjusting device 460, the inner space of the water tank 41 may go into a state identical or similar to vacuum pressure, thereby preventing water from being discharged from the discharging hole 482.

On the other hand, when the inner space and the outer space of the water tank 41 is allowed to communicate by the adjusting device 460, the pressure of the inner space of the water tank 41 may become identical or similar to atmospheric pressure, enabling smooth discharge of water from the discharging hole 482.

Specifically, the tank body 410 is provided with an air hole 430 for air to be introduced into the tank body 410. The air hole 430 may be provided in the second water storage part 412, but there is no limitation thereto. Alternatively, the air hole 430 may be provided in the first water storage part 411, or the air hole 430 may be provided in each of the first water storage part 411 and the second water storage part 412.

The adjusting device 460 may be rotatably coupled to the tank body 410. Depending on the rotating position of the adjusting device 460, the adjusting device 460 may open or close the air hole 430.

The adjusting device 460 may include a connecting part 461 or 462 rotatably connected to the tank body 410, and a transmitting part 465 or 466 that receives a rotational force of the cleaner body 10 in the process where the cleaner body 10 rotates in one direction.

The connecting part 461 or 462 may be rotatably connected to the tank body 410 by a hinge 463. Here, the tank body 410 may be provided with a hinge coupling part 418 to which the hinge 463 may be coupled.

The connecting part 461 or 462 may be coupled to a cover part 464 that opens and closes the air hole 430.

Here, the adjusting device 460 may include a plurality of connecting parts 461 and 462 so that the adjusting device 460 rotates stably and is prevented from being deformed in the rotation process, and the transmitting part 465 or 466 may connect the plurality of connecting parts 461 and 462. Of course, the adjusting device 460 may include only one connecting part 462.

For example, the adjusting device 460 may include a first connecting part 461 rotatably coupled to the first water storage part 411, and a second connecting part 462 rotatably coupled to the second water storage part 412.

Further, one or more of the first connecting part 461 and the second connecting part 462 may be coupled to the cover part 464.

Here, for the adjusting device 460 to receive the rotational force of the cleaner body 10 in the process where the cleaner body 10 rotates in one direction, the transmitting part 465 or 466 may be disposed on a rotation route of the cleaner body 10.

For example, the transmitting parts 465 and 466 may include a plurality of first transmitting parts 465 bend-connected to each connecting part 461 or 462, and one or more second transmitting parts 466 that may connect the plurality of first transmitting parts 465 and contact the cleaner body 10.

Here, for the adjusting device 460 to receive the rotational force of the cleaner body 10, at least a portion of the adjusting device 460 may be arranged such that it is not overlapped with the nozzle assembly 20 in an up and down direction.

For example, the connecting part 461 or 462 is arranged such that at least a portion thereof is overlapped with the nozzle assembly 20 in an up and down direction, and the transmitting part 465 or 466 is arranged such that at least a portion thereof is not overlapped with the nozzle assembly 20 in an up and down direction.

The water cleaning device 40 may further include an elastic member 458 that provides elastic force to the adjusting device 460 so that the state where the adjusting device 460 has closed the air hole 430 may be maintained when the cleaner body 10 is in a stand up state.

Therefore, in a state where the rotational force is not transmitted from the cleaner body 10 to the adjusting device 460, the state where the cover part 464 of the adjusting device 460 has closed the air hole 430 may be maintained by the elastic force of the elastic member 458.

In the tank body 410, an accommodating groove 432 for accommodating a portion of the cover part 464 may be formed, and the air hole 430 may be formed at a bottom of the accommodating groove 423, but there is no limitation thereto.

For example, the accommodating groove 462 may be formed on an upper surface of the tank body 410.

Therefore, in a state where the cover part 464 of the adjusting device 460 has closed the air hole 430, the connecting part 461 or 462 may extend in a front and rear direction of the nozzle assembly 20, the first transmitting part 465 may extend in an up and down direction, and the second transmitting part 466 may extend in a left and right direction of the nozzle assembly 20.

Hereinafter, actions of the adjusting device will be explained.

Figure 9:
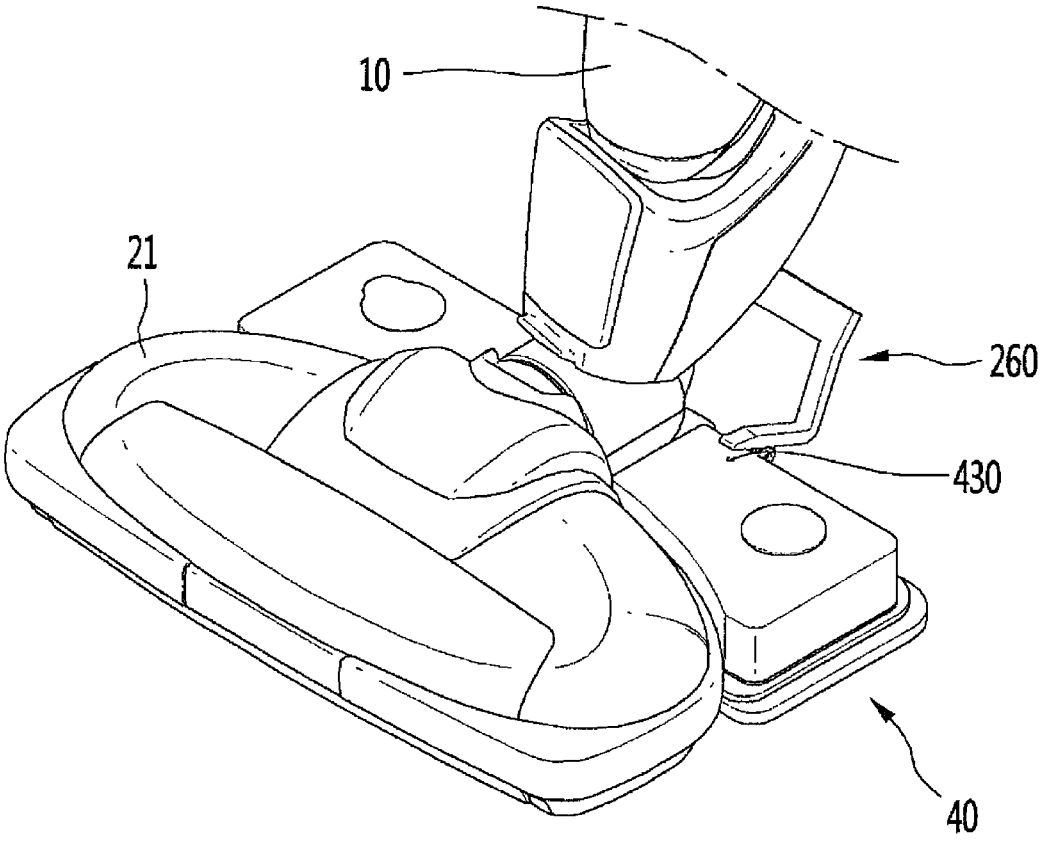
FIG. 9 is a view illustrating a state where a cleaner body is rotated in one direction.
Figure 10:
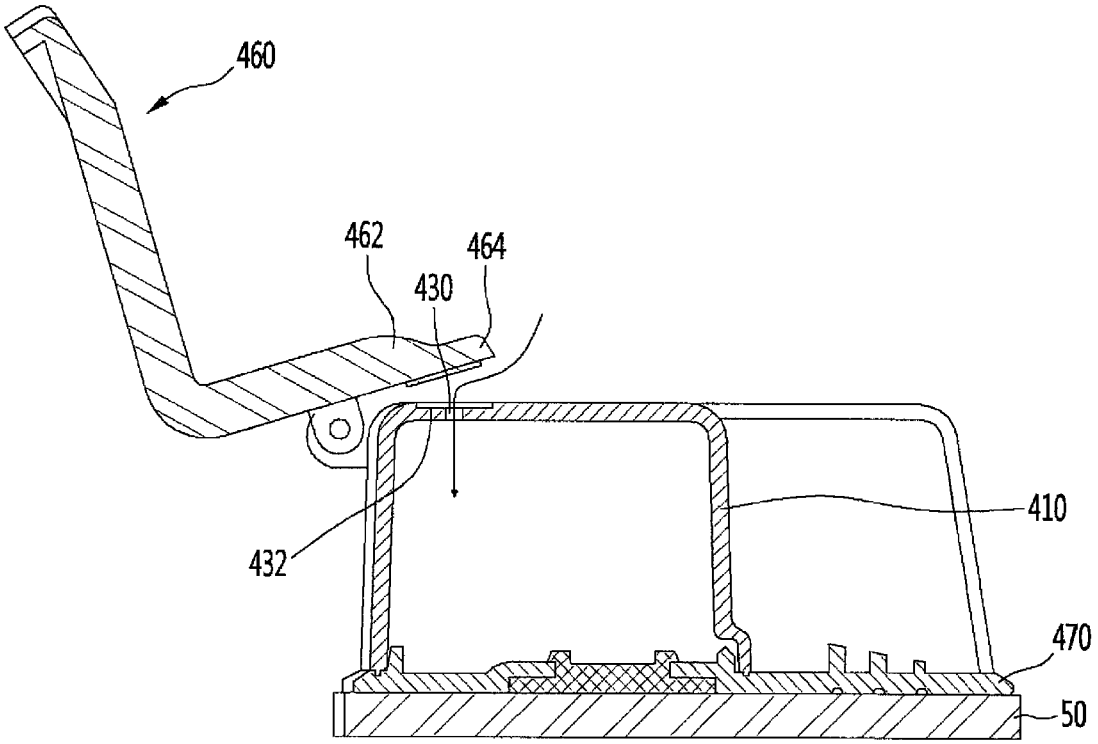
FIG. 10 is a view illustrating a state where an adjusting device is rotated to open an air hole.

FIG. 9 is a view illustrating a state where the cleaner body is rotated in one direction, and FIG. 10 is a view illustrating a state where the adjusting device is rotated to open the air hole.

First of all, referring to FIG. 1, FIG. 7 and FIG. 8, when the cleaner body 10 is in a stand up state, the state where the adjusting device 460 is spaced apart from the cleaner body 10, and the adjusting device 460 has closed the air hole 430 may be maintained.

For example, the transmitting part 465 or 466 may be disposed at a rear side of the cleaner body 10, and spaced apart from the cleaner body 10.

Alternatively, when the cleaner body 10 is in a stand up state, the adjusting device 460 may contact the cleaner body 10, and the state where the adjusting device 460 has closed the air hole 430 may be maintained.

In the state where the air hole 430 is closed, air is prevented from being introduced from outside into the water tank 41 through the air hole 430.

In this case, the inner space of the water tank 41 may go into a state identical or similar to vacuum pressure, thereby preventing the water from being discharged from the discharging hole 482.

When the cleaner body 10 is in a stand up state as aforementioned, water is prevented from being discharged from the water tank 41, and thus in a cleaner standby state, water may be prevented from being unnecessarily discharged from the water tank 41.

When water is prevented from being unnecessarily discharged from the water tank 41, a period of time where the water stored in the water tank 41 may be used increases, thereby reducing the number of times water needs to be filled in the water tank 41.

Meanwhile, referring to FIG. 9 and FIG. 10, when the cleaner body 10 rotates in one direction, rotational force of the cleaner body 10 is transmitted to the adjusting device 460, thereby rotating the adjusting device 460 in one direction.

Then, the cover part 464 of the adjusting device 460 is spaced apart from the air hole 430, thereby opening the air hole 430. When the air hole 430 opens, air may be introduced into the water tank 41 through the air hole 430, and thus the inner pressure of the water tank 41 becomes identical or similar to atmospheric pressure, thereby discharging water from the discharging hole 482.

The water discharged from the discharging hole 482 is supplied to the cloth 50 so that the cloth 50 absorbs the water.

Therefore, the user may clean a floor surface using the cloth 50 that absorbed the water.

According to the present disclosure, the air hole is closed in a cleaner standby state, thereby preventing water from being discharged from the water tank unintentionally.

Further, according to the present disclosure, without having to manually manipulate the adjusting device, when the user rotates the cleaner body to clean, the adjusting device rotates, thereby opening the air hole. Therefore, there is an advantage of improved user convenience.

Further, in the cleaning process, water may be discharged from the water tank continuously without any additional manipulation by the user.

Further, even when the water cleaning device is separated from the nozzle assembly, the state where the adjusting device has closed the air hole is maintained, thereby preventing water from being discharged from the water tank.

Although it was explained in the aforementioned embodiment that the adjusting device is rotatably connected to the water tank, the adjusting device may be provided in the cleaner body 10 instead.

For example, the air hole may be formed at a side surface of one of the first water storage part and the second water storage part, and the adjusting device provided in the cleaner body 10 may open or close the air hole depending on the position of the cleaner body 10. The adjusting device may be an exterior part of the cleaner body.

Alternatively, the adjusting device may protrude from the cleaner body, and a groove for accommodating the adjusting device may be formed in the water tank, and the air hole may be disposed in the groove.

The invention claimed is:

1. A cleaner comprising:

a nozzle assembly;

a cleaner body that is coupled to the nozzle assembly and that is configured to rotate; and a water cleaning device that is coupled to the nozzle assembly, the water cleaning device including:

a water tank that is configured to (i) hold a cloth and (ii) store water to provide to the cloth and that includes an air hole through which air enters the water tank from outside of the water tank, and an adjusting device that is configured to open or close the air hole based on a rotation of the cleaner body.

2. The cleaner of claim 1, wherein the adjusting device is configured to move, based on the rotation of the cleaner body, between a first position and a second position to open or close the air hole.

3. The cleaner of claim 2, wherein the adjusting device is configured to (i) move to the first position based on the cleaner body being oriented in an upright orientation and (ii) move to the second position based on rotation of the cleaner body.

4. The cleaner of claim 3, wherein the adjusting device is configured to (i) close the air hole based on the adjusting device being located in the first position and (ii) open the air hole based on the adjusting device being located in the second position.

5. The cleaner of claim 2, further comprising:

an elastic member that is configured to maintain the adjusting device in the first position to close the air hole.

6. The cleaner of claim 1, wherein the adjusting device includes:

a transmitting part that is configured to move based on rotation of the cleaner body, a connecting part that couples the transmitting part to the water tank and that is configured to rotate about a first axis based on movement of the transmitting part, and a cover part that is coupled to the connecting part and that is configured to move, based on the rotation of the connecting part, to open or close the air hole.

7. The cleaner of claim 6, wherein the transmitting part is configured to move without contacting the nozzle assembly.

8. The cleaner of claim 6, wherein the transmitting part is configured to move between a first transmitting position and a second transmitting position, and wherein, in the first transmitting position, at least a portion of the transmitting part is located at a first side of the cleaner body and is spaced apart from the cleaner body.

9. The cleaner of claim 6, wherein the water tank includes:

an accommodating groove that is configured to accommodate a portion of the cover part and that is located on a first surface of the water tank, and wherein the air hole is located on a first surface of the accommodating groove.

10. The cleaner of claim 1, wherein the adjusting device includes:

a transmitting part including:

a first transmitting part that is configured to move based on rotation of the cleaner body, and a plurality of second transmitting parts that are coupled to the first transmitting part and that are configured to move based on movement of the first transmitting part, and a first connecting part and a second connecting part, wherein each of the first connecting part and the second connecting part (i) respectively couples at least one of the plurality of second transmitting parts to the water tank and (ii) is configured to respectively rotate about a first axis based on movement of the at least one of the plurality of second transmitting part.

11. The cleaner of claim 10, wherein the first connecting part and the second connecting part extend in a first direction, and the plurality of second transmitting parts extend in a second direction that is different from the first direction.

12. The cleaner of claim 10, wherein the water tank includes:

a first water storage part that is configured to store water to provide to the cloth and that is rotatably coupled to the first connecting part, and a second water storage part that is configured to store water to provide to the cloth and that is rotatably coupled to the second connecting part.

13. The cleaner of claim 12, wherein the nozzle assembly includes:

a connecting part that is coupled to the cleaner body, and wherein the connecting part is located between the first water storage part and the second water storage part.

14. The cleaner of claim 12, wherein the first water storage part includes the air hole, and wherein the first connecting part that is coupled to the first water storage part includes a cover part that is configured to open or close the air hole.

15. The cleaner of claim 14, wherein the second water storage part includes a second air hole through which air enters the second water storage part from outside of the water tank, and wherein the second connecting part that is coupled to the second water storage part includes a second cover part that is configured to open or close the second air hole.

16. The cleaner of claim 12, wherein at least one of the first water storage part or the second water storage part includes the air hole, and wherein at least one of the first water storage part or the second water storage part includes a water inlet through which water enters the water tank.

17. A cleaner comprising:

a nozzle assembly;

a water cleaning device that is coupled to the nozzle assembly and that includes:

a water tank that is configured to (i) hold a cloth and (ii) store water to provide to the cloth and that includes an air hole through which air enters the water tank from outside of the water tank; and a cleaner body that is coupled to the nozzle assembly, that is configured to rotate, and that includes:

an adjusting device that is configured to open or close the air hole based on rotation the cleaner body.

18. The cleaner of claim 17, wherein the adjusting device is configured to move, based on rotation of the cleaner body, between a first position and a second position to open or close the air hole.

19. The cleaner of claim 18, wherein the adjusting device is configured to (i) move to the first position based on the cleaner body being oriented in an upright orientations and (ii) move to the second position based on rotation of the cleaner body.

20. The cleaner of claim 18, further comprising:

an elastic member that is configured to maintain the adjusting device in the first position to close the air hole.

* * * * *